United States Patent [19]

Nishikawa

[11] 4,051,781

[45] Oct. 4, 1977

[54] INK ROLLER CARTRIDGE

[75] Inventor: Tatsuo Nishikawa, Tachikawa, Japan

[73] Assignees: Canon Kabushiki Kaisha, Tokyo; Cannon Denshi Kabushiki Kaisha, Saitama, both of Japan

[21] Appl. No.: 682,800

[22] Filed: May 3, 1976

[30] Foreign Application Priority Data

May 28, 1975 Japan ..... 50-63887

[51] Int. Cl.[2] ..... B41F 31/30

[52] U.S. Cl. ..... 101/348; 101/103

[58] Field of Search ..... 101/348, 103, 104, 106, 101/108, 328–331

[56] References Cited

U.S. PATENT DOCUMENTS

| | | | |
|---|---|---|---|
| 1,291,057 | 1/1919 | Marks | 101/103 |
| 3,326,124 | 6/1967 | Heil et al. | 101/348 UX |
| 3,759,178 | 9/1973 | Franchinot | 101/349 |
| 3,785,288 | 1/1974 | Hunter | 101/103 |

*Primary Examiner*—J. Reed Fisher

*Attorney, Agent, or Firm*—Fitzpatrick, Cella, Harper & Scinto

[57] ABSTRACT

An ink roller cartridge having an ink roller rotatably mounted therewithin is formed with an opening through which the ink roller is engageable with a printing type drum when the cartridge is mounted on a printer body. The cartridge is provided with a lid to close the opening. A knob is provided on the outer periphery of the ink roller cartridge to facilitate the mounting and dismounting of the cartridge.

4 Claims, 8 Drawing Figures

INK ROLLER CARTRIDGE

BACKGROUND OF THE INVENTION

1. Field of the Invention

This invention relates to an ink roller cartridge which serves as means for supplying ink to a printer.

2. Description of the Prior Art

The printer using an ink roller has heretofore been constructed as shown in FIG. 1 of the accompanying drawings. A printing type drum 1 is disposed between frames 3 provided on the opposite sides. The drum 1 is rotatable about its shaft 1*a* by a motor (not shown). An ink roller 2 is urged against the periphery of the printing type drum 1 by the shaft 2*a* of the ink roller which is received in the groove 3*a* of each frame 3 and biased by springs 4, so that the ink roller 2 is also rotatable with rotation of the printing type drum 1. The ink roller 2 is formed of a porous material capable of storing therein a great deal of ink and thus, the ink may be transferred from the outer periphery of the ink roller 2 onto printing types arranged on the outer periphery of the printing type drum 1.

According to this system, the groove 3*a* is formed in a portion of each frame 3 and the roller shaft 2*a* only at its opposite ends is inserted from outside into the grooves 3*a* with the entire outer surface of the ink roller 2 exposed, and the ink roller is urged against the printing type drum by the springs 4 to transfer the ink onto the printing types.

This construction has been disadvantageous in that each time the ink roller is mounted on or dismounted from the printer, the ink may stick to the printer's external portion, the printer case and the hands or fingers of the operator to thereby degrade the commercial value of the printer.

The present invention eliminates such a disadvantage.

SUMMARY OF THE INVENTION

It is an object of the present invention to simplify the procedures of mounting the ink roller on the printer body and dismounting the same therefrom.

It is another object of the present invention to provide a knob on the outer periphery of a cartridge to prevent the hands of the operator from being stained by ink during the mounting and dismounting of the ink roller with respect to the printer body.

It is still another object of the present invention to provide a cartridge constructed as a unit in which a cylindrical case covers the ink roller to protect the latter and one half-circular portion of the cylindrical shape is used as the cartridge while the other half-circular portion of the cylindrical shape is formed so as to be separable as a lid, the cartridge and the lid being half-fixed by means of clicks so that the interior of the cartridge may be protected against the atmosphere and external forces.

It is yet still another object of the present invention to provide a cartridge which is mountable on and dismountable from the printer without the use of any tool.

The invention will become more fully apparent from the following detailed description thereof taken in conjunction with the accompanying drawings.

DESCRIPTION OF THE PREFERRED EMBODIMENTS

Figure 1:
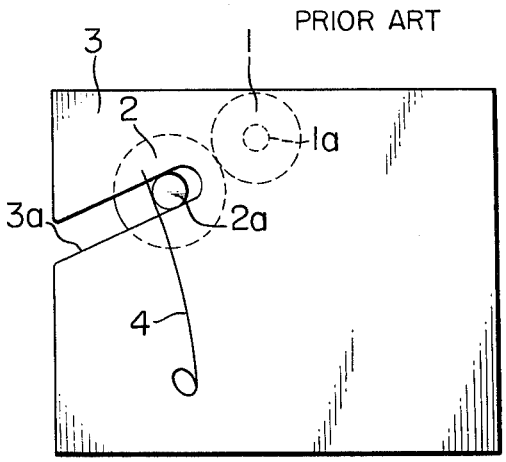
FIG. 1 PRIOR ART
FIG. 1 shows a printer according to the prior art.
Figure 2:
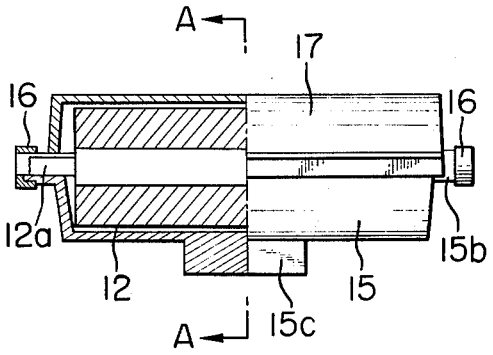
FIGS. 2, 2A and 2B show an ink roller cartridge unit according to the present invention, FIG. 2B being a cross-sectional view taken along the line A—A of FIG. 2.
Figure 2A:
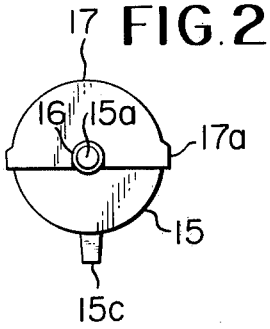
Figure 2B:
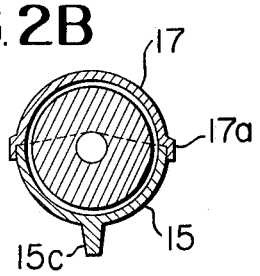
Figure 3:
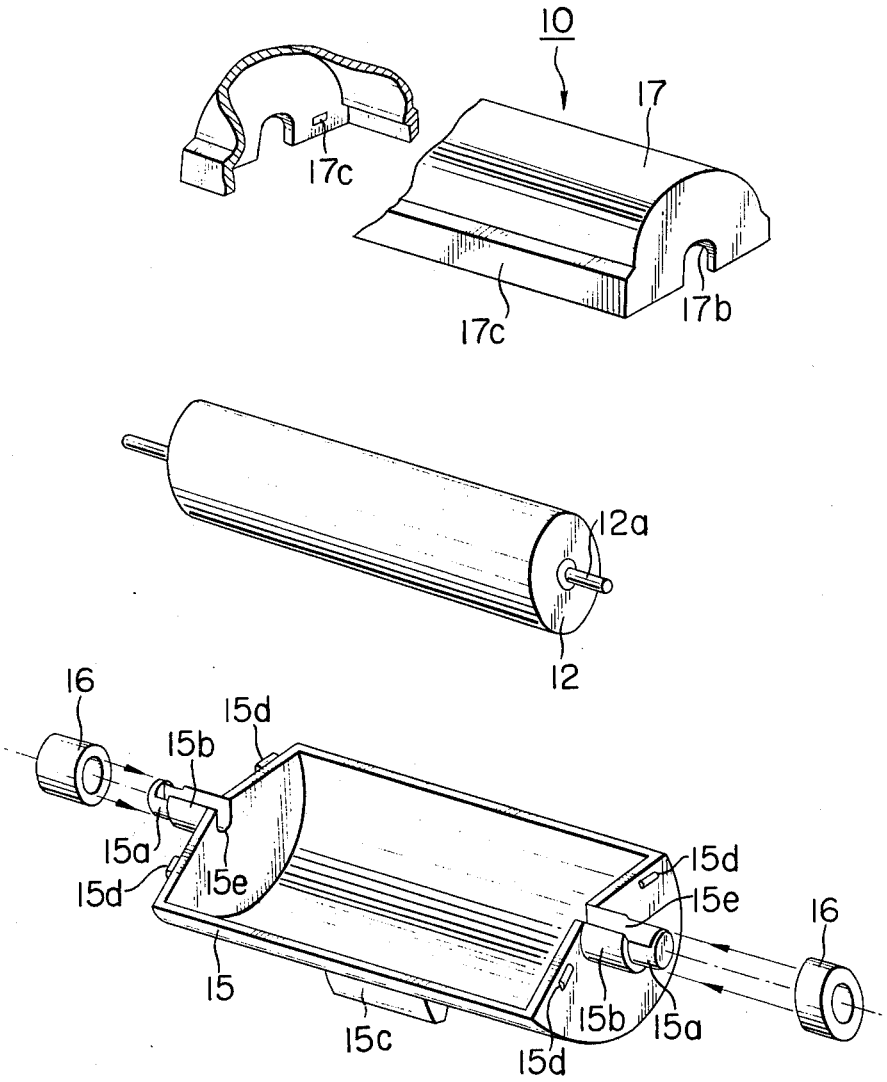
FIG. 3 is an exploded sketch of the ink roller cartridge unit shown in FIG. 2.

Reference will first be had to FIG. 2 showing the ink roller cartridge unit according to the present invention, and also to FIG. 3 which is a sketch for making FIG. 2 easier to understand. The ink roller 12 is formed of a porous material and stores therein a great deal of ink. The roller 12 has a shaft 12*a* extending therethrough along the center axis thereof and integrally secured thereto so that the roller 12 is rotatable with the shaft 12*a*.

The shaft 12*a* is received in grooves 15*e* formed in the opposite ends of a cartridge 15, and securing rings 16 are inserted over shaft securing portions 15*a* to thereby assemble the ink roller 12 and the cartridge 15 together for free rotation of the ink roller 12 within the cartridge 15.

The cartridge 15 is formed as a semicircular cylinder so as to permit substantially one half of the outer periphery of the ink roller 12 to be exposed and urged against the outer periphery of a printing type drum (not shown). Thus, the opening of the cartridge 15 serves as a window through which ink may be transferred from the ink roller onto printing types. Provided on the outer periphery of the cartridge 15 is a knob 15*c* to simplify the procedures of mounting the cartridge on the printer and dismounting the same therefrom. Four protrusions 15*d* are provided on the opposite end surfaces of the cartridge 15. These protrusions may be received in recesses 17*c* formed in a lid 17, thus forming the cartridge unit 10 in which the ink roller 12 may be protected against the atmosphere and external forces.

Figure 4:
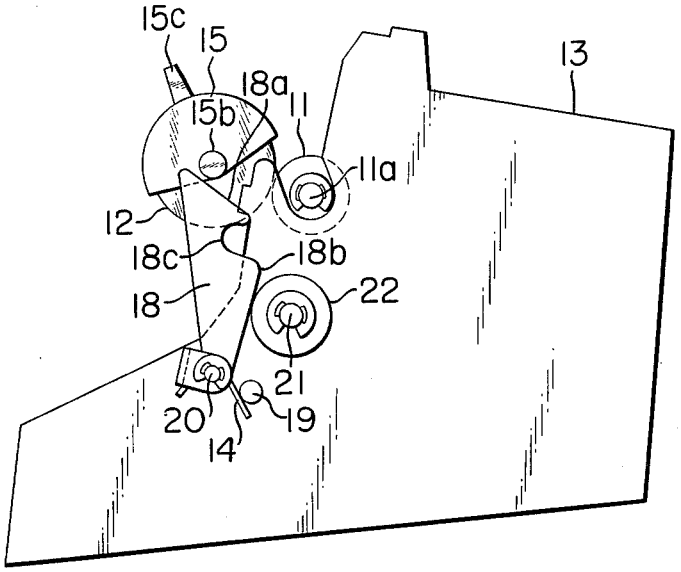
FIG. 4 is a view showing the ink roller cartridge unit while it is being mounted on a printer.
Figure 5:
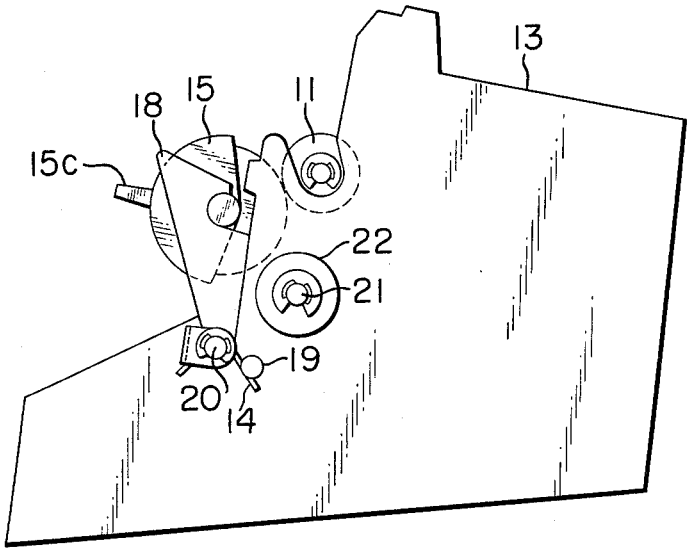
FIG. 5 shows the ink roller cartridge unit when it has been mounted on the printer.

FIG. 4 shows the cartridge 15 while it is being mounted on the printer with the lid 17 removed from the ink cartridge unit. To mount the ink roller cartridge 15 on the printer, the lid 17 is first removed from the cartridge by holding between fingers the knob 15*c* formed on the outer periphery of the cartridge, whereafter the outer periphery of the ink roller 12 is brought into contact with the outer periphery of the printing type drum 11 while, at the same time, bearing portions 15*b* formed on the opposite end portions of the cartridge 15 are made to bear against the sloped portions 18*a* of levers 18, and then the cartridge is forced downwardly with the knob 15*c* held between fingers, whereby the bearing portions 15*b* pivotally move the levers 18 leftwardly against the force of springs 14 and comes down to be received in curved recesses 18*c* of the levers 18, so that the ink roller 12 is mounted in a predetermined position as shown in FIG. 5. The levers 18 are then pivoted rightwardy about a shaft 20 by the force of the springs 14 until they strike against discs 22 secured to a shaft 21 and serving to stop the levers 18.

Figure 6:
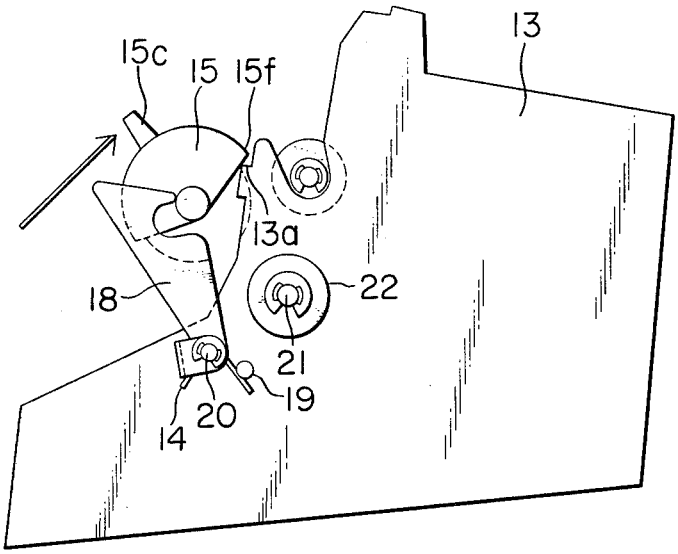
FIG. 6 shows the ink roller while it is being dismounted from the printer.

FIG. 6 shows the ink roller cartridge 15 while it is being removed for interchange. When a force is exerted on the knob 15*c* in the direction of arrow with the cartridge 15 mounted in the predetermined position (FIG. 5), portions 15*f* of the cartridge 15 strike against cutaway portions 13*a* of the frame 13 so that the levers 18 pivot leftwardly about the shaft 20 with the cutaway portions 13*a* as the strut, thus permitting the cartridge 15 to be readily removed from the printer body.

According to the present invention, as has been described above, the ink roller of very excellent transfer characteristic may be operated safely and reliably by a simple construction and this means a great convenience in the practical use. Further, the lid 17 of the present cartridge unit 10 is not restricted to the illustrated removable form, but the lid 17 may take other various forms. For example, the lid 17 may be designed to be slidably placed on the cartridge 15 or the lid may be joined to the cartridge by a flexible sheet.

What is claimed is:

1. An ink roller device for use with printing apparatus which includes a printing type drum, comprising:

a shaft;

an ink roller, integral with said shaft, for contacting the printing type drum to apply ink thereto;

an ink roller cartridge for accommodating said ink roller and formed with an opening for exposure therethrough of said roller, said cartridge including a pair of side plates each having a portion rotatably receiving said shaft;

means for holding said shaft at said receiving portions after the shaft has been positioned therein;

a pair of levers for supporting said receiving portions, said levers each having a recess for receiving one of said receiving portions and having adjacent sides forming an acute angle at one end thereof for guiding one of said receiving portions toward the open end of its respective recess and toward one of the sides of the printing type drum; and a pair of spring means for continuously urging said levers and said ink roller cartridge carried thereby toward the printing type drum.

2. A device according to claim 1, further comprising means for preventing overtilting of said levers in the absence of said cartridge to place the acute angle end of said levers at such a position that said cartridge is easiy mounted on said levers.

3. An ink roller device for use with printing apparatus which includes a printing type drum, comprising:

an ink roller cartridge for accommodating an ink roller, said ink roller cartridge having an opening and a shaft;

a pair of side plates each having a portion engageable with a portion of the ink roller device, and disposed orthogonally with respect to said shaft;

a pair of levers each having an end mounted on one of said side plates for pivotal movement relatively thereto, and the other end being provided with a recess for receiving an end of said shaft, and also provided with sides forming an acute angle end for guiding said cartridge toward said recess;

a pair of springs each mounted continuously to urge one of said levers toward the printing type drum; and stopper means for limiting the movement of the acute ends of the levers in a direction toward the drum at such a position that said cartridge is easily manually mountable on said levers.

4. A device according to claim 3, wherein said engageable portion functions as a center of such pivotal movement of said cartridge as to move said levers away from the printing type drum upon removing said cartridge.

* * * * *